United States Patent [19]

Haas

[11] 4,415,098

[45] Nov. 15, 1983

[54] SINGLE BEAD DISPENSER

[75] Inventor: Tommy B. Haas, Antioch, Ill.

[73] Assignee: Abbott Laboratories, North Chicago, Ill.

[21] Appl. No.: 274,002

[22] Filed: Jun. 15, 1981

[51] Int. Cl.[3] ..... B65H 3/60

[52] U.S. Cl. ..... 221/202; 221/264; 221/276

[58] Field of Search ..... 221/263, 264, 266, 276, 221/202; 222/361, 243, 362

[56] References Cited

U.S. PATENT DOCUMENTS

| | | | |
|---|---|---|---|
| 470,018 | 3/1892 | Strong | 222/361 |
| 2,561,339 | 7/1951 | Chediak . | |
| 2,683,551 | 7/1954 | Riveron . | |
| 2,781,947 | 2/1957 | Webster et al. . | |
| 2,838,204 | 6/1958 | Snyder . | |
| 3,294,284 | 12/1966 | Chambers . | |
| 3,332,576 | 7/1967 | Hamilton | 221/264 |
| 3,342,318 | 9/1967 | Ruekberg et al. . | |
| 3,446,397 | 5/1969 | Chambers . | |
| 3,545,164 | 12/1970 | Middleton | 221/264 |
| 4,101,284 | 7/1978 | Difiglio et al. . | |

FOREIGN PATENT DOCUMENTS

| | | |
|---|---|---|
| 137635 | 12/1906 | Fed. Rep. of Germany . |
| 866981 | 7/1949 | Fed. Rep. of Germany . |
| 1969420 | 9/1967 | Fed. Rep. of Germany . |
| 6914830 | 8/1969 | Fed. Rep. of Germany . |

*Primary Examiner*—H. Grant Skaggs
*Attorney, Agent, or Firm*—Steven M. Odre

[57] ABSTRACT

A bead dispenser for gravity feed dispensing beads one at a time from a plurality thereof. A main dispenser body includes a bead reservoir, a bead outlet and a cavity between the reservoir and the outlet for receiving a slidable, retractable plunger having an aperture alignable with the bead outlet. Opposing respective angled surfaces on the plunger and the dispenser main body are adapted to individually feed the beads into the plunger aperture for dispensing one at a time.

7 Claims, 4 Drawing Figures

SINGLE BEAD DISPENSER

This invention relates to dispensing apparatus and in particular to apparatus for dispensing beads one at a time into containers used for diagnostic assay testing.

BACKGROUND OF THE INVENTION

Reference may be made to the following U.S. Pat. Nos.: 4,101,284; 2,561,339; 2,781,947; 2,838,204; 3,342,318; 3,294,284; 3,446,397; 2,683,551; and German Pat. No. 866,981.

The use of solid supports referred to hereinafter as beads, dispensed into reaction containers or wells in conducting immunologic assays is described for example in the aforementioned U.S. Pat. No. 4,101,284. Presently available multiple bead dispensers generally provide a slidable plate having a plurality of apertures each to be filled with a bead from a bead reservoir. The plate may then be moved to align the plate apertures with a plurality of corresponding outlet apertures to enable dispensing of the beads. However, the beads have a tendency to hang together and bridge across openings, rather than falling directly into each of the plate apertures, thus dispensing less than the anticipated and desired number of beads.

Bead dispensers in the form of an elongated cylinder with a tip deformable to dispense a bead at a time are also available. While useful under certain circumstances, occasionally dispensing becomes erratic due to a deformed cylinder or sticking of beads under extreme humidity conditions.

It is therefore desirable to provide a reliable bead dispenser of relatively inexpensive construction. Further, it is desired to provide such a bead dispenser which can rapidly and reliably dispense beads one at a time from a plurality of beads.

SUMMARY OF THE INVENTION

In accordance with the principles of the present invention, there is provided a bead dispenser for gravity feed dispensing beads one at a time from a plurality of beads. The dispenser includes a main body having a bead reservoir, an outlet for the beads below the reservoir, and a cavity intermediate the reservoir and the bead outlet. A slidable plunger suitably sized with respect to the main body cavity is insertable into the cavity for normally blocking the bead outlet in a plunger retracted position. The plunger includes an aperture through which beads may pass into the outlet upon slidable insertion of the plunger to a bead dispensing position to align the plunger aperture and the main body or bead outlet. Opposing respective angled surfaces on the plunger and the main body are adapted to converge onto the plunger aperture to individually feed the beads into the plunger aperture for dispensing. Such feed means enable one at a time dispensing of the beads.

Specifically, the plunger includes an angled feed chute extending upwardly away from the plunger aperture. A guide ramp on the main body projects downwardly from the reservoir side opposite from the plunger feed chute, with the guide ramp including an angled ramp face extending upwardly away from the plunger aperture and opposite from the angled feed chute so that as the plunger is inserted into the bead dispensing position, the angled feed chute and angled ramp face cooperate to urge only one bead of the plurality of beads in the reservoir into a position immediately above the plunger aperture. Thus, as the bead which is in the plunger aperture is dispensed from the main body outlet, and the plunger begins to be retracted, the next bead is allowed to fall into the plunger aperture for dispensing during the next operation of the plunger.

The feed chute is grooved so as to substantially conform to the size of a single bead. In addition, the reservoir may include opposite interior surfaces angled inwardly convergent toward the main body cavity on both sides of the plunger, with the interior surfaces formed of different respective convergent angles. Thus, the present bead dispenser includes distinctive feed means to prevent bead hang-up and bridging and to urge the positioning of one bead at a time directly over the plunger aperture for feeding of the bead into the plunger aperture upon plunger retraction and reliable dispensing of the beads one at a time upon insertion of the plunger into the bead dispensing position.

In accordance with another aspect of the present invention, retraction means, such as a spring engageable with the plunger and the main body are provided for urging the plunger outwardly from the main body. A stop ledge on the plunger engaging an abuttment on the guide ramp prevents complete retraction of the plunger from the main body. In addition, limit means are provided to limit slidable insertion of the plunger as it is inserted into the main body cavity, so as to position the plunger at the bead dispensing position with the plunger aperture aligned with the main body outlet.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the several figures and in which:

DETAILED DESCRIPTION

Figure 1:
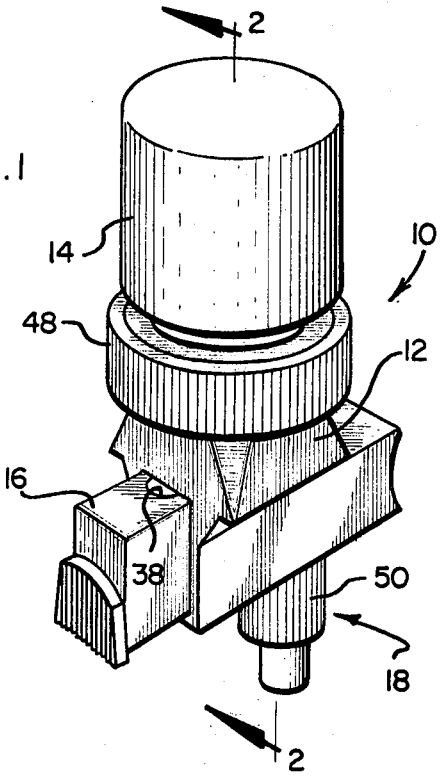
FIG. 1 is a perspective view of a bead dispenser having a main body and a plunger with distinctive feed means to individually dispense beads one at a time and constructed in accordance with the principles of the present invention.

Referring to FIG. 1, there is illustrated a bead dispenser 10 including a main body 12 to which there has been threadably engaged a bottle 14 containing plastic beads. As an example, the bottle may contain 100 beads of ¼ inch diameter each coated with antibodies and/or antigens. Bead dispenser 10 includes a slidable plunger 16 which when inserted into main body 12 enables the operator to dispense beads one at a time from outlet 18 into the appropriate containers ussed for diagnostic assay testing.

Figure 3:
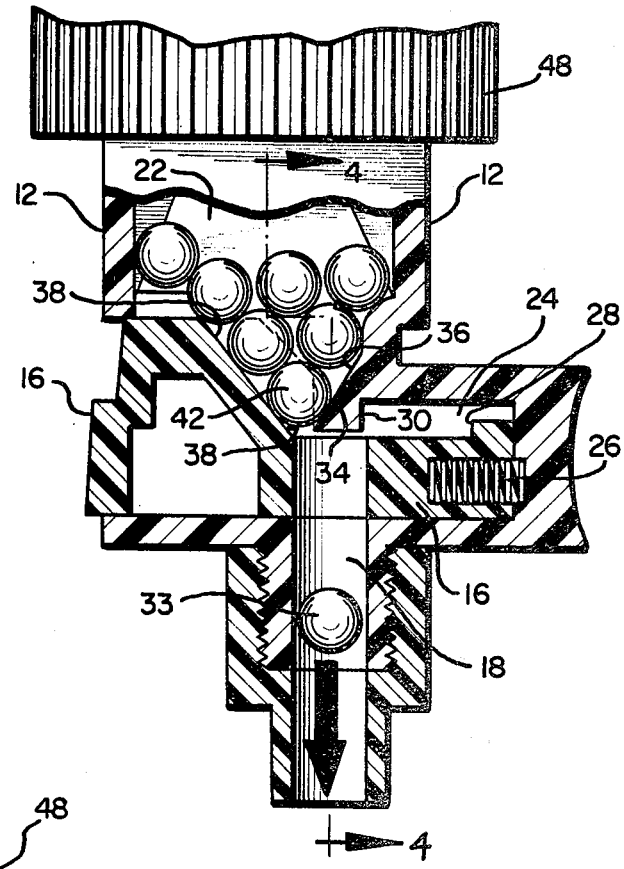
FIG. 3 is a sectional view of the bead dispenser of FIG. 1 illustrating the plunger in the bead dispensing position.
Figure 2:
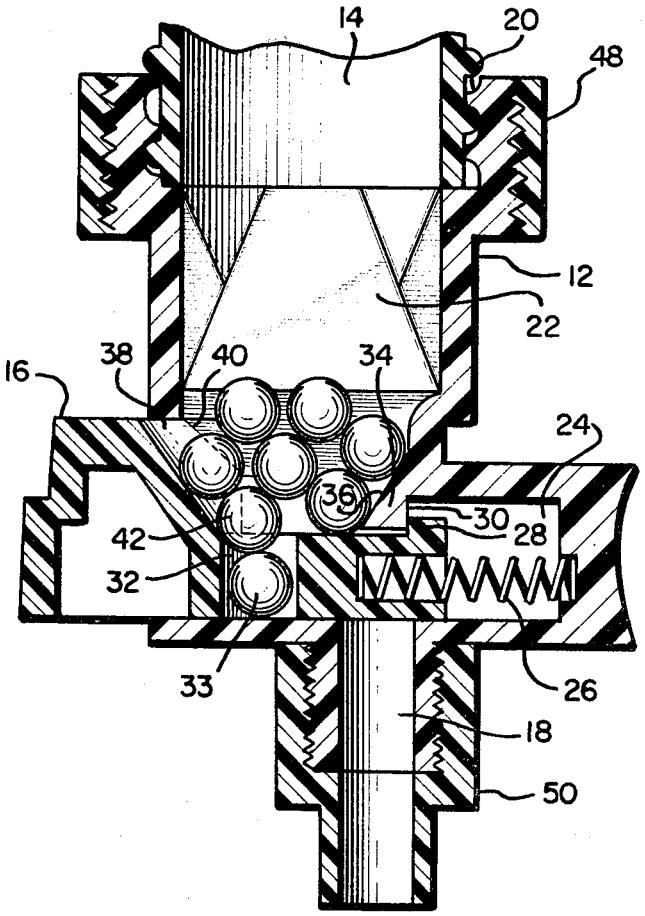
FIG. 2 is a sectional view, taken along section line 2—2 of FIG. 1, illustrating the plunger in its retracted position.
Figure 4:
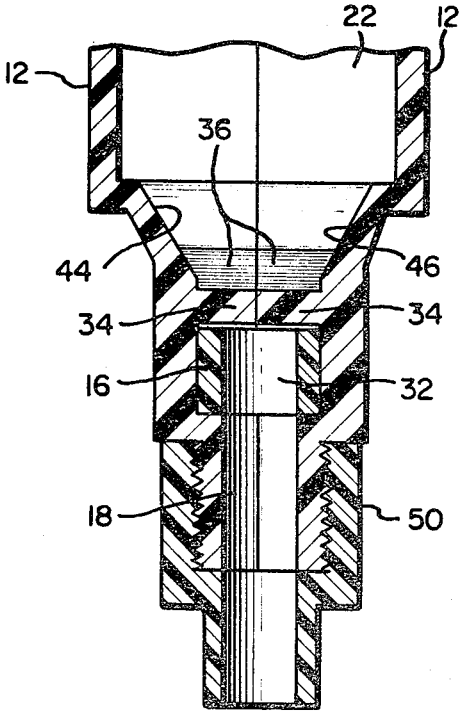
FIG. 4 is a sectional view, taken along section lines 4—4 illustrating the slightly different angles on two interior, opposing side walls of the main body cavity.

Reference may now be made to FIGS. 2–4 illustrating a preferred embodiment of the present invention. One end of main body 12 includes interior threads 20 for threadably engaging the main body with suitable threads on bead container bottle 14. The main body further includes a bead reservoir 22 for receiving a plurality of beads from bottle 14 when the bead dispenser is placed in the position shown in the drawings. Main body 12 further includes an elongated cavity 24 into which the plunger is inserted.

FIG. 2 illustrates the plunger at the retracted position provided by retraction means such as spring 26 having one end fixed to the plunger and another end insertable into a suitable slot in the main body at one end of cavity 24. Spring 26 urges plunger 16 until a stop ledge 28 engages an abuttment 30. In the position of the bead dispenser shown in FIG. 2, outlet 18 is blocked from the bead reservoir to prevent undesired dispensing of the beads.

FIG. 3 illustrates plunger 16 in the bead dispensing position with the central axis of outlet 18 being placed in alignment with an aperture 32 provided in the plunger. As shown in FIG. 3, bead 33 which had been in plunger aperture 32 in the retracted position (FIG. 2) is now passing out of outlet 18. In addition, another single bead has been selected from the plurality of beads in reservoir 22 and has been maneuvered by the distinctive feed means within the bead dispenser to a position immediately above the plunger aperture. In particular, a guide ramp 34 projects downwardly from the bottom of reservoir 22 into the upper portion of cavity 24. The guide ramp includes a ramp face 36 angled outwardly away from the plunger aperture.

In addition, a feed chute 38 provided on plunger 16 includes a grooved surface extending at an angle upwardly away from plunger aperture 32. The angled grooved feed chute is bounded on opposite sides by plunger side walls 40 and formed so as to substantially conform to the bead size.

As can be seen most conveniently with reference to FIG. 3, the guide ramp cooperates with the feed chute to maneuver a single bead 42 from the plurality of beads into a position immediately above the plunger aperture. Note that bead 42 engages angled feed chute 38 and angled ramp face 36. Thus, as plunger 16 is retracted, bead 42 will fall into aperture 32 for dispensing on the next operation of the plunger. Guide ramp 34 projects into cavity 34 to extend substantially over the plunger aperture with ramp face 36 extending at approximately a 35° angle with respect to the central axis of plunger aperture 32. Also, the angled grooved surface of feed chute 38 is formed with a similar angle with respect to the central axis of plunger aperture 32. In a constructed embodiment of the invention, ramp face 36 was formed at a 35° angle, whereas grooved feed chute 38 was formed with an angle of 34° with respect to the plunger aperture central axis.

FIG. 4 illustrates the construction of the interior walls of main body 12. In particular, an angled interior side wall 44 at the bottom of reservoir 22 and on one side of the plunger is formed with a slightly different angle than the corresponding angled interior surface 46 on the opposite side of the plunger. In a constructed embodiment of the invention, one of the angled interior surfaces 44, 46 was formed at 30° whereas the other surface was formed at 33° with respect to the central axis of main body 12. The slightly differing surface angles encourage the beads to be vertically off-set as they move downwardly in the reservoir towards the plunger aperture, thus further enabling the substantial elimination of bead hang-up and bridging.

Thus, there has been provided a bead dispenser which can be readily constructed with a minimum of moving parts and with a minimum of parts requiring strict dimentional tolerances. A constructed embodiment was formed with two main body portions, each identical except for the differing interior angled side surfaces 44, 46; a plunger; a threaded nut 48 threadably engaged onto each main body half portion; and a threaded nut 50 threadably engaged onto outlet 18. Threaded nuts 48 and 50 maintain the bead dispenser 10 in an assembled condition. It is understood, of course, that other embodiments of the invention are possible to construct which incorporate the distinctive feed means illustrated in the specific embodiment herein to positively insure that a bead will be dispensed each time the operator inserts plunger 16 to the bead dispensing position.

It may be noted for instance that limit means are provided to limit slidable insertion of the plunger, i.e., the plunger forward end will contact the end of cavity 24, as shown in FIG. 3, to position the plunger aperture in alignment with the bead outlet. Alternatively, the leading edge of projection guide ramp 34 could be formed to contact the bottom of feed chute 38 to position the plunger at the desired bead dispensing position.

The foregoing detailed description has been given for clearness of understanding only, and no unnecessary limitations should be understood therefrom, as modifications will be obvious to those skilled in the art.

What is claimed is:

1. A bead dispenser for gravity feed dispensing one bead at a time from a plurality of beads, said bead dispenser comprising:

a main body having a reservoir for said beads, an outlet below said reservoir, and a cavity intermediate the reservoir and outlet;

a slidable plunger adapted for insertion into said main body cavity, including an aperture through said plunger alignable with the main body outlet upon slidable insertion of the plunger to a bead dispensing position;

said reservoir including opposite interior surfaces angled inwardly convergent towards the cavity intermediate the reservoir and outlet, on both sides of the plunger with interior surfaces formed of different respective convergent angles;

said plunger and angled feed chute extending upwardly away from said plunger aperture;

a guide ramp on said main body projecting downwardly from the reservoir on a reservoir side opposite from said feed chute;

said guide ramp including an angled ramp face extending upwardly away from said aperture and opposite from said feed chute with said plunger in the bead dispensing position;

said angled feed chute and said opposing angled ramp face cooperating to individually feed said beads into said plunger aperture for dispensing;

said plunger and guide ramp adapted to substantially restrict all but one bead of said plurality of beads from being positioned immediately above said plunger aperture with the plunger in the bead dispensing position; and said feed chute is grooved to substantially conform to the size of a single bead.

2. A bead dispenser according to claim 1, wherein said guide ramp includes a projecting edge portion immediately adjacent said plunger and extending over the plunger aperture with the plunger in the bead dispensing position.

3. A bead dispenser according to claim 1, including retraction means engageable with the plunger and main body for urging the plunger outwardly from the main body.

4. A bead dispenser according to claim 3, including a stop ledge on the plunger and an abuttment on said guide ramp, wherein said stop engages said abuttment to prevent complete retraction of said plunger from said main body.

5. A bead dispenser according to claim 4, including means for limiting slidable insertion of said plunger to position the plunger at the bead dispensing position.

6. A bead dispenser according to claim 1, wherein said main body outlet has a central axis offset from said reservoir, and said guide ramp includes a projecting edge portion extending substantially over said main body outlet.

7. A bead dispenser according to claim 1, wherein said angled feed chute and said angled ramp face each extend at an angle of about 35° with respect to the central axis of said plunger aperture.

* * * * *